US005704422A

United States Patent [19]

Chess et al.

[11] Patent Number: 5,704,422

[45] Date of Patent: Jan. 6, 1998

[54] SHROUDED HEAT EXCHANGER

[75] Inventors: David Durham Chess; Mark Elliott Taylor, both of Houston, Tex.; Raj Kumar Khanna, Dhahran, Saudi Arabia; William Dale Henderson; Ronald William Hill, both of Houston, Tex.

[73] Assignee: Huntsman Specialty Chemicals Corporation, Salt Lake City, Utah

[21] Appl. No.: 445,041

[22] Filed: May 19, 1995

[51] Int. Cl.[6] ..... F28F 9/22

[52] U.S. Cl. ..... 165/160; 165/161; 165/DIG. 402; 165/DIG. 407

[58] Field of Search ..... 165/159, 160, 165/161, 110; 122/33, 37, 123, 367.1, 367.2

[56] References Cited

U.S. PATENT DOCUMENTS

| | | | |
|---|---|---|---|
| 2,084,743 | 6/1937 | Rathbun | 165/161 X |
| 2,091,757 | 8/1937 | Hanny | 165/161 X |
| 2,499,302 | 2/1950 | Emhardt | 122/34 X |
| 2,964,926 | 12/1960 | Ware | 165/110 X |
| 2,995,341 | 8/1961 | Danesi | 165/110 X |
| 3,048,373 | 8/1962 | Bauer et al. | 165/161 X |
| 3,267,693 | 8/1966 | Richardson et al. | 165/160 X |
| 3,326,280 | 6/1967 | Bosquain et al. | 165/161 |
| 4,016,835 | 4/1977 | Yarden et al. | 165/159 X |
| 4,228,845 | 10/1980 | Cowling | 165/110 X |

*Primary Examiner*—Leonard R. Leo

*Attorney, Agent, or Firm*—Russell R. Stolle; Carl G. Ries

[57] ABSTRACT

A heat exchanger is provided, including a tubular shell having an opening in one end thereof, an open-topped, side-slotted shroud mounted inside the shell, a bundle of tubes extending through the opening into the shroud, means for circulating a hot fluid through the bundle of tubes, means for charging a heat-exchange fluid to the space between the shell and the shroud for flow through slots into the shroud and into indirect heat exchange contact with the bundle of tubes for cooling the hot fluid, and means for removing heated exchange fluid from the top of said shell.

14 Claims, 2 Drawing Sheets

SHROUDED HEAT EXCHANGER

BACKGROUND OF THE INVENTION

1. Field of the Invention

This invention relates to an indirect heat exchanger. More particularly, this invention relates to a tubular heat exchanger comprising a shell containing a bundle of heat exchanger tubes, means for circulating a hot fluid through the bundle of tubes and means for flowing a cooling fluid through the shell for indirect heat exchange contact with the tube bundle in order to cool the contents of the tube bundle. Still more particularly, this invention relates to a heat exchanger comprising a tubular shell having a shroud mounted therein and spaced from the wall thereof, the shroud having openings such as slots, ports, etc., in the side thereof, a bundle of heat exchange tubes mounted in the shell inside the shroud, means connected with the heat exchanger tubes for circulating a hot fluid therethrough, means mounted in the side of the shell for charging a heat exchange fluid to the space between the shell and the shroud for flow through the slots into the shroud and into indirect heat exchange contact with the bundle of tubes to cool the hot fluid and means mounted above the shroud for removing heat exchange fluid from the shell.

2. Prior Art

It is known to mount a bundle of tubes in a shell, to flow a hot fluid through the tubes and to flow a cooling fluid through the shell for indirect heat exchange contact with the bundle of tubes in order to cool the fluid in the tubes. For example, heat exchangers of this nature are widely used in petroleum refining operations and chemical plant operations in order to cool the various hydrocarbon streams that are present in the plant. Typically, the cooling fluid is water which is inexpensive and widely available and which can also be used for the generation of steam for use in the plant.

Typically, a laterally mounted tubular shell is used having an opening at one end thereof and the tube bundle is inserted into the shell through the opening. Means are provided for charging the heat exchange fluid (e.g., water) to the shell and for removing the heat exchange fluid (e.g., steam) from the shell.

A feature that is encountered with apparatus of this nature is the problem of froth formation. As the cooling water is converted to wet steam, a steam/water froth is formed. The froth is not stable and rapidly separates into wet steam and water, but in a continuous operation the froth will be continually present and occupies a significant amount of the space within the shell. As a consequence, normally the "reserve supply" of water within the shell is very limited such that the heat exchanger will rapidly "run dry" if the supply of water to the heat exchanger is interrupted for any significant length of time for any reason.

SUMMARY OF THE INVENTION

The present invention is directed to a tubular kettle-type heat exchanger containing a reservoir spaced from a bundle of tubes to be cooled.

More particularly, the present invention is directed to a kettle-type heat exchanger comprising a tubular shell having an opening in one end thereof, an open-topped, side-slotted shroud mounted in the shell and spaced from the sides thereof, a bundle of tubes extending into the opening in the shell into the shroud, means connected with the ends of the tube for circulating a hot fluid through the bundle of tubes, means mounted in the side of the shell for charging a heat exchange fluid to the space between the shell and the shroud for flow through the slots into the shroud and into indirect heat exchange contact with the bundle of tubes for cooling the hot fluid and means mounted above the shroud for removing heated exchange fluid from the shell. With this arrangement, the space between the outer side of the shroud and the shell constitutes a reservoir for holding heat exchange liquid and the slots adjacent the bottom of the shroud permit flow of the heat exchange liquid through the shroud and into contact with a bundle of tubes for indirect heat exchange cooling of the contents in the tubes. With this arrangement, froth that is formed during the heat exchange operation is contained within the shroud. As a consequence, if flow of cooling liquid to the shell is interrupted, even for an extended period of time such as thirty minutes to an hour, there will be sufficient liquid coolant within the heat exchanger to permit continued operations while there is an orderly shutdown of the unit.

In accordance with a more preferred embodiment of the present invention, there is provided a heat exchanger for cooling a fluid flowing through an elongate bundle of tubes comprising a lateral, elongate, tubular shell segment closed at one end thereof and asymmetrically open at the other end thereof to define an opening adjacent to the bottom of the shell having a diameter smaller than the diameter of the shell, an elongated open-top shroud, shorter length than said shell, mounted in said shell, extending from the opening in said shell and spaced from the sides of said shell, the shroud having slots formed in the sides thereof adjacent the bottom thereof, a lateral baffle fixed to the end of the shroud remote from the opening in the shell, a bundle of tubes shorter in length than the length of the shroud mounted in the opening in the shell and extending into the shroud and spaced to the sides thereof whereby the shroud and the lateral baffles define a shell-side reservoir and a tube-side reservoir, means connected with the ends of the bundle of tubes for circulating a hot fluid to be cooled through the bundle of tubes, inlet line means mounted in the side of the shell for charging a cooling fluid to the shell-side reservoir for flow through the slots into the tube-side reservoir and into heat exchange contact with the bundle of tubes for indirect heat exchange cooling of the hot circulating fluid flowing through the bundle of tubes and outlet means mounted above the shroud for removing heated exchange fluid from the shell. As indicated above, when tubular heat exchangers are used in manufacturing plants such as petroleum refineries or chemical manufacturing plants, it is conventional to use water as the coolant in order to generate wet steam for use in a process being conducted in the plant.

In accordance with the present invention, a method is provided for generating wet steam by bringing water into indirect heat exchange contact in a shelled tubular heat exchanger containing a bundle of tubes through which is flowed a stream of fluid having a temperature above the boiling point of water in order to convert the heat exchange water to wet steam, the improvement for defrothing of the steam formed during the heat exchange step comprising the steps of establishing an inlet water reservoir in the tubular heat exchanger spaced and apart from the bundle of tubes, continually charging fresh water to the inlet water reservoir and from thence to the bottom of the bundle of tubes for upward flow therethrough to convert the fresh water to wet steam whereby frothing of the water will occur within the bundle of tubes during the steam conversion, continuously channeling the frothy wet steam upwardly to a vapor space at the top of the shell and away from the bundle of tubes, continually defrothing the wet steam in the vapor space, continually withdrawing defrothed steam from the vapor space at the top of the tubular heat exchanger and continually returning the separated water to the heat exchange reservoir, outside the shroud.

DESCRIPTION OF THE PREFERRED EMBODIMENT

Figure 1:
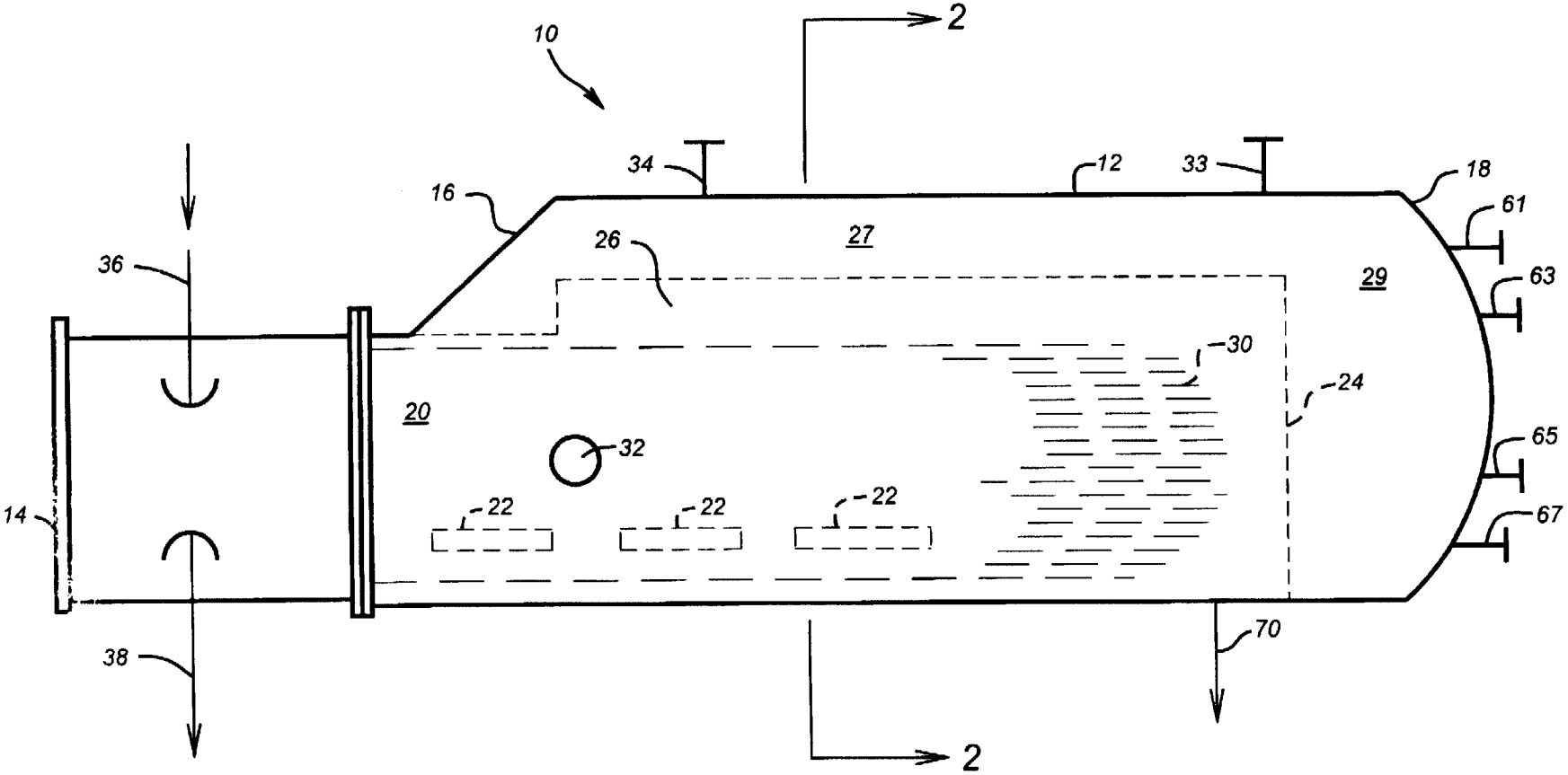
FIG. 1 is a sectional side elevation view. Conventional parts are not shown.

Turning now to the drawings, and especially to FIG. 1, there is shown a lateral kettle-type heat exchanger designated generally by the numeral 10 comprising a tubular shell 12 having inner facing lateral sides and outer facing lateral sides and an opening 14 in the end thereof. In accordance with the preferred embodiment of the present invention, the tubular shell 12 is provided with an asymmetrical neck 16 defining the opening 14 which is located adjacent the bottom of the shell. It will be observed that the opening 14 will have a diameter of about 30% to about 80% of the diameter of the shell 12.

Figure 2:
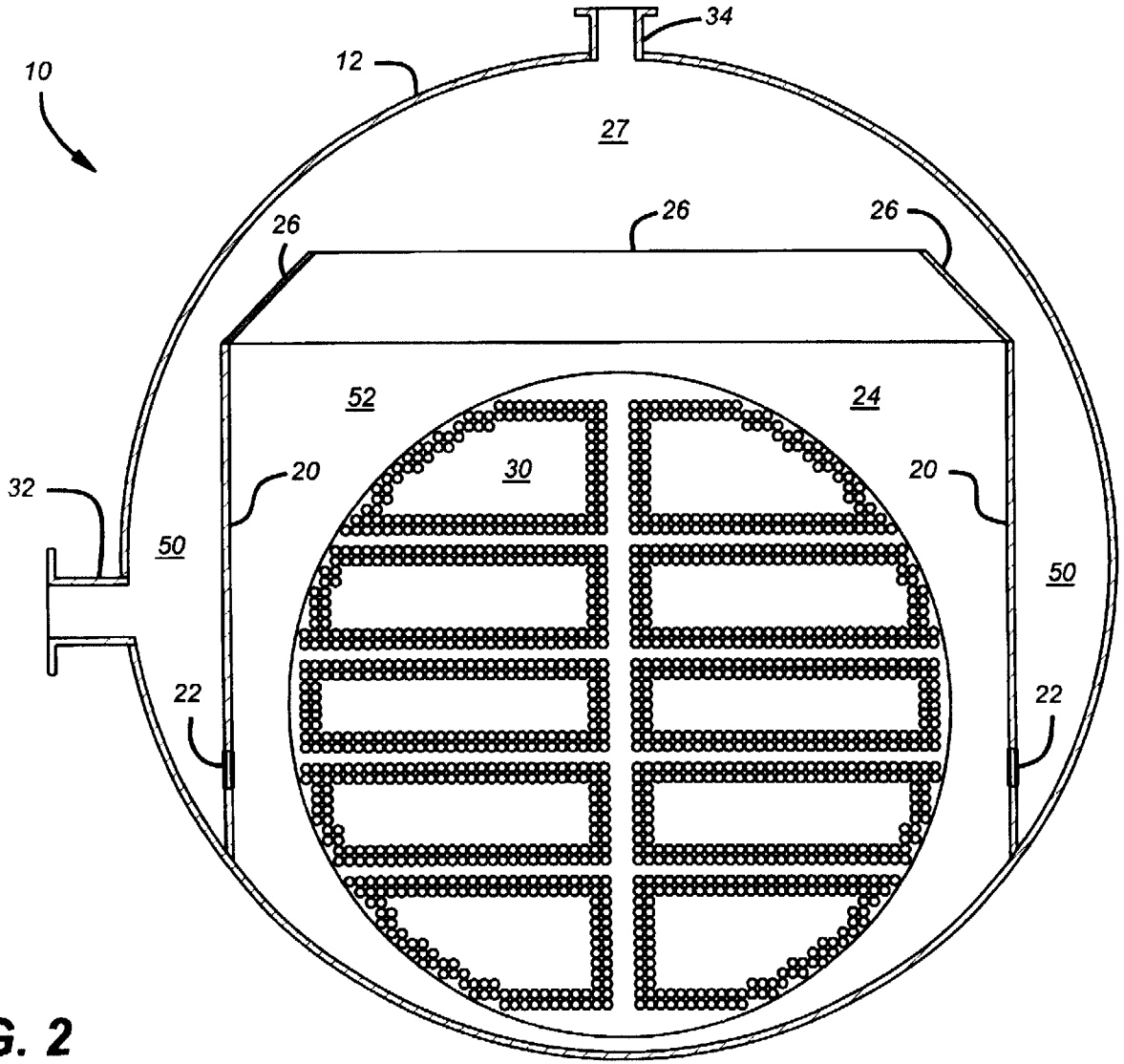
FIG. 2 is a cross-sectional view taken along the lines 2—2 of FIG. 1.

As is shown in FIG. 1 and more clearly in FIG. 2, an elongate open-topped shroud 20 is mounted in the shell and extends from the opening in the shell and is spaced from the inner sides thereof and is provided with side slots 22 adjacent the bottom thereof.

A lateral baffle 24 having an inner face and an outer face is fixed to the end of the shroud 20 the end thereof remote from the opening in the shell.

A deflector plate 26 is mounted to the top of the shroud 20 and angled inwardly.

The space 27 above the deflector plates 26 constitutes a vapor space.

A bundle of tubes designated generally by the number 30 is mounted in the shell 12, extending into the interior of the shell 12 through the opening 14 at one end thereof. The ends of the bundle of tubes 34 are adjacent to the opening 14 in the shell.

The shroud 20 has a length less than the length of the shell 12 defining a supplemental shell side reservoir space between the outer face of baffle 24 and the remote end 18 of the inner faces of the shell 12. A feed inlet means such as a feed nozzle 32 is provided in the side of the shell 12 for introducing a heat exchange fluid into the shell. Suitable outlet means such as a plurality of outlet pipes 34 are provided at the top of the shell for removing heat exchange fluid after contact with the bundle of tubes.

Suitable safety means such as a pressure relief valve 33 of any suitable conventional structure is also mounted in the top of the shell 12 in the event that there is an excess buildup of pressure within the shell 12.

An inlet means 36 is provided for delivering a hot fluid to be cooled to the bundle of tubes and an outlet means 38 is provided for withdrawing cooled fluid from the bundle of tubes.

With this arrangement, the space between the inner faces of the shell 12 and the outer face of the shroud 20 defines a shell-side reservoir 50 and the space inside the inner face of the shroud 20 defines a tube-side tube bundle reservoir 52.

The shell 12 is desirably proportioned so as to provide a vapor space at the top of the shell above the tube bundle 30 to permit separation of the steam/water froth. With reference to FIG. 2, the vapor space 27 may comprise about 30% to about 50% of the space inside the shell 12. The volume of the fluid to be maintained in the shell side reservoir 50 (outside of the shroud 20) and the supplemental reservoir space 29 will be determined by design parameters such as the rate of flow of fluid to the shell 12 through the line 32, the desired residence time of the fluid within the reservoirs 50 and 29, etc. For example, the shroud 20 and the lateral baffle 24 may be positioned within the shell 12 in a manner such that about 15% to about 75% of the fluid in the shell 12 is present in the reservoirs 50 and 29; the remaining fluid volume being present in the tube bundle reservoir 52. Thus, the shell side reservoir 50 and 29 may comprise about 10 to about 50 vol.% of the total volume of shell 12 and the tube bundle reservoir 52 may correspondingly comprise about 10 to aout 50 vol.% of the total volume of shell 12.

A bottom draw-off line 70 is provided for the removal of fluid from the shell 12, as desired.

Suitable means are provided at the remote end of the shell for sensing the level of liquid in the shell such as liquid level sensors 61, 63, 65 and 67. The space 29 between the end of the lateral baffle 24 and the remote end of the shell 12 constitutes a supplemental heat exchange fluid reservoir 29.

OPERATION

In operation, a fluid to be cooled such as a stream of hydrocarbons in a chemical plant or in a refinery is charged to tube bundle 30 by inlet line 36. A cooling fluid, such as water, is charged to the shell-side reservoir 50 through the inlet line 32 for flow through the slots 22 and the shroud 20 into the shell-side reservoir 52 for contact with the tubes in the tube bundle 30 for indirect heat exchange contact with the contents of the tubes in order that they may be cooled.

When the heat exchange fluid is water, the water will be convened to wet steam which will rise through the reservoir 52 into the vapor space 27 above the tube bundle 30.

As indicated, a water/steam froth will form within the tube bundle 30 during the heat exchange operations and will be entrained in the wet steam flowing into the vapor space 27. The froth will be decomposed within the vapor space 27 to form water which will flow down the outside of the deflector plates 26 back to the shell-side reservoir and wet steam which is withdrawn from the shell 12 through the outlet line 34.

The sensors 61–67 will sense the level of water within the supplemental reservoir 29 and the shell side reservoir 50 by conventional control apparatus (not shown) and will sound an alarm (not shown) in the event that the level of liquid in the supplemental reservoir 29 and the shell side reservoir 50 drops below a desired point.

EXAMPLE

By way of example, the fluid to be introduced into the bundle of tubes 30 by the inlet 36 may comprise a solution of tertiary butyl alcohol, tertiary butyl hydroperoxide, propylene and liquid catalyst to be reacted within the tube bundle 30 to provide tertiary butyl alcohol and propylene oxide. This is a liquid phase exothermic reaction, so the concentration of reactants fed to the inlet 36 will be dilute. For example, the stream charged by the inlet line 36 may comprise a tertiary butyl alcohol solution containing about 35 to about 60 wt.% of tertiary butyl hydroperoxide admixed correspondingly with about 65 to 40 wt.% of tertiary butyl alcohol, the solution also containing from about 1.1 to about 1.9 moles of propylene per mole of tertiary butyl hydroperoxide in the solution.

It will be desirable to maintain the charged solution 36 at a predetermined temperature, such as a temperature of about 270° F., and to remove the heat of reaction from the stream flowing through the tube bundle 30 by indirect heat exchange contact with water whereby the water is converted to wet steam. For example, the solution of tertiary butyl hydroper-oxide and propylene in tertiary butyl alcohol may be charged to the inlet 36 at the rate of about 300 to about 600 gallons per minute at a temperature of about 270° F. and a pressure of about 45 psia. Water is charged to the shell-side reservoir 50 through the inlet line 32 at the rate of about 6500 lbs. per hour. The water flows through the slots 22 in the shroud 20 into the tube-side reservoir 52 and into contact with the tube bundle 30 for indirect heat exchange contact with the flowing stream of solution of tertiary butyl alcohol, tertiary butyl hydroperoxide and propylene. As a consequence, about 6500 lbs. per hour of 15 lb. gage steam will be formed which will flow into the vapor space 27 and from thence from the heat exchanger 10 by way of the discharge line 34. Froth formed within the tube bundle 30 will be carried upwardly into the vapor space 29 where it will disengage to form water which will return to the shell-side reservoir flowing past the baffles 26 and wet steam which is withdrawn from line 34.

Having described our invention, what is claimed is:

1. A heat exchanger comprising:

a tubular shell having inner facing lateral sides and outer facing lateral sides and an opening in one end thereof, an open-topped, laterally sided shroud mounted in said shell adjacent said opening in said shell, said shroud having inner facing sides and outer facing sides and having slots in the sides thereof, said shroud being spaced from the inner facing sides of said shell and defining a shell-side reservoir in the space between the inner facing sides of said shell and the outer facing sides of said shroud, a bundle of tubes mounted in said opening in said shell and extending into said shroud and spaced from the idler facing sides thereof and defining a tube-side reservoir in the space between the bundle of tubes and the inner facing sides of the shroud, the ends of said bundle of tube being adjacent said opening in said shell, means connected with the ends of said tubes for circulating a hot fluid through said bundle of tubes, means mounted in the side of said shell for charging a heat-exchange fluid to the shell-side reservoir for flow through said slots into said shroud and into heat exchange contact with said bundle of tubes in said tube-side reservoir for cooling said hot fluid, and means mounted on said shell above said shroud for removing heated exchange fluid from said shell.

2. A heat exchanger as in claim 1 wherein the tubular shell is longer than the bundle of tubes, wherein the shroud is longer than the bundle of tubes and wherein a lateral baffle is fixed to the end of said shroud remote from the opening in the shell to augment the volume of the shell side reservoir.

3. A heat exchanger for cooling a fluid flowing through an elongated bundle of tubes comprising:

an elongated laterally disposed tubular shell having inner facing lateral sides and outer facing lateral sides and an opening at one end thereof, an open-topped, laterally sided shroud mounted in said shell adjacent said opening in said shell, said shroud having inner facing sides and outer facing sides and having slots an the sides thereof, said shroud being spaced from the inner facing sides of said shell and defining a shell-side reservoir in the space between the inner facing sides of said shell and the outer facing sides of said shroud, an elongated bundle of tubes mounted in said opening in said shell, extending into said shroud and spaced from the inner facing sides of said shroud and defining a tube-side reservoir, the ends of said bundle of tubes being adjacent said opening in said shell, means connected with the ends of said bundle of tubes for circulating a hot fluid to be cooled through said bundle of tubes, means mounted in the side of said shell for charging a cooling fluid to said shell-side reservoir for flow through said slots into said tube-side reservoir and into heat exchange contact with said bundle of tubes for cooling said hot fluid circulating through said bundle of tubes, and means mounted above said shroud for removing heated exchange fluid from said shell.

4. A heat exchanger as in claim 3 wherein the shroud is longer than the bundle of tubes, wherein the tubular shell is longer than the shroud and wherein a lateral baffle is fixed to the end of said shroud remote from the opening in the shell to augment the volume of the shell side reservoir.

5. A heat exchanger as in claim 4 including means mounted in said shell in the end thereof remote from said opening for sensing a drop below a predetermined level of the level of heating fluid in said shell-side reservoir.

6. A heat exchanger as in claim 5 wherein the slots in said shroud are located adjacent the bottom of said shroud.

7. A heat exchanger for cooling a fluid flowing through an elongated bundle of tubes comprising:

a shell comprising a lateral elongated tubular segment closed at one end thereof and asymmetrically necked at the other end thereof to define an opening adjacent the bottom of said shell having a diameter smaller than the diameter of said shell, said shell having inner facing lateral sides and an outer facing lateral sides, an elongated open-topped laterally sided shroud, shorter in length than said shell, mounted in said shell, extending from the opening in said shell, said shroud having inner facing sides and outer facing sides and having slots in the sides thereof adjacent the bottom thereof, said outer facing sides of said shroud being spaced from the inner facing sides of said shell and defining a shell side reservoir, a lateral baffle fixed to the end of said shroud remote from the opening in the shell further defining said shell side reservoir, a bundle of tubes shorter than the length of said shroud mounted in said opening in said shell and extending into said shroud and spaced from the inner sides thereof, whereby said bundle of tubes and the inner facing sides of said shroud define a tube-side reservoir, the ends of said bundle of tubes being adjacent said opening in said shell, means connected with the ends of said bundle of tubes for circulating a hot fluid to be cooled through said bundle of tubes, inlet line means mounted in the side of said shell for charging a cooling fluid to said shell-side reservoir for flow through said slots into said tube-side reservoir and into heat exchange contact with said bundle of tubes for cooling said hot fluid circulating through said bundle of tubes, and outlet line means mounted above said shroud for removing heated exchanger fluid from said shell.

8. A heat exchanger as in claim 7 including means mounted in said shell in the end thereof remote from said opening for sensing a drop below a predetermined level of the level of heating fluid in said shell-side reservoir.

9. A heat exchanger for cooling chemical reactants flowing through an elongate bundle of tubes comprising:

a shell comprising a lateral elongate tubular segment closed at one end thereof and asymmetrically necked at the other end thereof to define an opening adjacent the bottom of said shell, said shell having inner facing lateral sides and an outer facing lateral sides, an elongate open-topped laterally sided shroud mounted in said shell, said shroud having inner facing sides and outer facing sides, said shroud extending from the opening in said shell and spaced from the inner facing sides of said shell, said outer facing sides of said shroud and said inner facing sides of said shell defining a shell side reservoir, said shroud having slots formed in the sides thereof adjacent the bottom thereof, said shroud having from about 60 to about 80 percent of the length of said shell, a lateral baffle having an inner facing side and an outer facing side fixed to the end of said shroud remote from the opening in the shell the outer facing side of said baffle and the inner facing sides of said shell further defining said shell side reservoir, a bundle of tubes mounted in said opening in said shell and extending into said shroud and spaced from the inner facing sides thereof, said bundle of tubes having from about 80 to about 95 percent of the length of said shroud whereby the inner facing sides of said shroud and the inner facing side of said baffle define a tube-side reservoir, the ends of said bundle of tubes being adjacent slid opening in said shell, means connected with the ends of said bundle of tubes for circulating hot chemical reactants to be cooled through said bundle of tubes, inlet line means mounted in the side of said shell for charging cooling water to said shell side reservoir for flow through said slots into said tube-side reservoir and into heat exchange contact with said bundle of tubes for cooling said hot chemical reactants circulating through said bundle of tubes, whereby said cooling water is converted to wet steam, and outlet line means mounted in said shell above said shroud for removing wet steam from said shell.

10. A heat exchanger as in claim 9 including means mounted in said shell in the end thereof remote from said opening for sensing a drop below a predetermined level of the level of water in said shell side reservoir.

11. A heat exchanger as in claim 9 including pressure relief valve means mounted in said shell above said bundle of tubes for venting the contents of said shell if the pressure in said shell exceeds a predetermined pressure.

12. A heat exchanger for cooling chemical reactants flowing through an elongated bundle of tubes and for converting cooling water into froth-free steam comprising:

a shell comprising a lateral elongated tubular segment closed at one end thereof and asymmetrically necked at the other end thereof to define an opening adjacent the bottom of said shell, said shell having inner facing lateral sides and an outer facing lateral sides, an elongate open-topped, side-panelled shroud mounted in said shell, extending from the opening in said shell and having from about 60 to about 80 percent of the length of said shell, said side panels being spaced from the inner facing sides of said shell, having inner facing sides and outer facing sides and having slots formed in the sides thereof adjacent the bottom thereof, said outer facing sides of said side panels and said inner facing sides of said shell defining a shell side reservoir, the tops of said panels being above the top of said bundle of tubes and spaced from the inner facing sides of said shell, thereby defining a defrothing vapor space at the top of said shell, a lateral baffle having an inner facing side and an outer facing side fixed to the end of said shroud remote from the opening in the shell, the outer facing side of said baffle and the inner facing sides of said shell further defining said shell side reservoir, a bundle of tubes having the cross-sectional configuration of said opening mounted therein and extending into said shroud and spaced from the inner facing sides thereof whereby the inner facing sides of said shroud and the inner facing side of said baffle define a tube-side reservoir, the ends of said bundle of tubes being adjacent said opening in said shell, means connected with the ends of said bundle of tubes for circulating hot chemical reactants to be cooled through said bundle of tubes, inlet line means mounted in the side of said shell for charging cooling water to said shell-side reservoir for flow through said slots into said tube-side reservoir and into heat exchange contact with said bundle of tubes for cooling said hot chemical reactants circulating through said bundle of tubes and for converting said water to wet steam, whereby froth is formed as said water is converted to steam within said bundle of tubes, and whereby said froth and said steam will flow upwardly through said bundle of tubes for defrothing of said steam in said vapor space, and outlet line means mounted in said shell above said vapor space for removing defrothed wet steam from said shell.

13. A heat exchanger as in claim 12 wherein deflector plates are mounted on the tops of said panels to deflect the flow water formed by the defrothing of the steam to said shell-side reservoir.

14. A heat exchanger as in claim 13 including means mounted in said shell in the end thereof remote from said opening for sensing a drop below a predetermined level of the level of water in said shell-side reservoir.

* * * * *